United States Patent [19]

Foster

[11] Patent Number: 4,810,162

[45] Date of Patent: Mar. 7, 1989

[54] MOUNTING A WORKING IMPLEMENT

[75] Inventor: Derek W. Foster, Littleover, United Kingdom

[73] Assignee: J. C. Bamford Excavators Limited, Rocester, United Kingdom

[21] Appl. No.: 75,670

[22] Filed: Jul. 20, 1987

[51] Int. Cl.[4] ..... E02F 3/28

[52] U.S. Cl. ..... 414/723; 37/118 A; 172/272; 292/216; 403/327

[58] Field of Search ..... 37/117.5, 118, 231; 172/272-275; 403/325, 326, 327, 330; 292/216; 285/311; 414/723

[56] References Cited

U.S. PATENT DOCUMENTS

| | | | |
|---|---|---|---|
| 2,924,473 | 2/1960 | Krause | 292/216 X |
| 3,334,934 | 8/1967 | Sandor | 292/216 |
| 3,512,804 | 5/1970 | Siegert | 37/231 X |
| 3,760,883 | 9/1973 | Birk | 37/231 X |
| 4,235,462 | 11/1980 | Torii et al. | 292/216 |
| 4,436,477 | 3/1984 | Lenertz et al. | 37/117.5 X |

FOREIGN PATENT DOCUMENTS

| | | | |
|---|---|---|---|
| 0122547 | 4/1984 | European Pat. Off. . | |
| 0143074 | 9/1984 | European Pat. Off. . | |
| 0184282 | 3/1985 | European Pat. Off. . | |
| 2409001 | 9/1974 | Fed. Rep. of Germany | 292/216 |
| 83/01473 | 9/1982 | PCT Int'l Appl. . | |
| 83/03629 | 3/1983 | PCT Int'l Appl. . | |
| 86/02681 | 8/1985 | PCT Int'l Appl. . | |
| 2004836 | 7/1978 | United Kingdom . | |
| 2040262 | 1/1980 | United Kingdom . | |
| 2053142 | 6/1980 | United Kingdom . | |
| 1592054 | 7/1981 | United Kingdom | 292/216 |
| 2167377 | 6/1985 | United Kingdom . | |
| 2169582 | 1/1986 | United Kingdom . | |
| 2177674 | 1/1987 | United Kingdom . | |

*Primary Examiner*—David A. Wiecking
*Assistant Examiner*—Moshe I. Cohen
*Attorney, Agent, or Firm*—Parmelee, Miller, Welsh & Kratz

[57] ABSTRACT

A device for releasably mounting a working implement such as an excavating or loading bucket on a working arm, such as an excavating arm of a vehicle comprises a housing which is, in use, secured to the working arm, the housing having a latch which is movable between a free position and a latched position, the latch being engageable with a co-operating receiving part of the working implement and retaining the receiving part of the implement when moved to its latched position, to secure the implement relative to the housing.

9 Claims, 4 Drawing Sheets

MOUNTING A WORKING IMPLEMENT

BACKGROUND TO THE INVENTION

This invention relates to a device for releasably mounting a working implement such as an excavating bucket, loader bucket, loader forks, or the like on a working arm such as an excavating arm or loading arm, of a vehicle such as an excavating or loading vehicle. The working arm may comprise an articulated boom, comprising a first arm part pivotally mounted on the vehicle and a second dipper arm part pivotally mounted with respect to the first arm part, the working implement being carried by the dipper arm part. Such a working arm is commonly known as an excavating arm.

Alternatively, the working arm may comprise a pair of booms each pivotally mounted on the vehicle and being connected together along their lengths with a working implement carried at the outer end thereof. Such a working arm is commonly known as a loader arm.

Presently, devices are known for mounting working implements on working arms which require an operator to dismount from his cab, to effect securement of the working implement on the arm.

An object of the present invention is to provide a new or improved device which overcomes or reduces this problem.

SUMMARY OF THE INVENTION

According to one aspect of the invention we provide a device for releasably mounting a working implement on a working arm, the device comprising a housing, means securing the housing to the working arm, a latch member mounted on the housing for movement relative to the implement between a free position and a latched position, first resilient biasing means biasing the latch member towards its free position, the working implement having a co-operating receiving means, the latch member being engageable with the co-operating receiving means when the latch member is in a free position and the latch member retaining the receiving means of the implement when moved against the force of the first resilient biasing means, to its latched position, the housing further comprising a locking element and second resilient biasing means biasing the locking element to a retaining position, the locking element being movable against the force of the second resilient biasing means as the latch member is moved to said latched position, and the locking element springing back into engagement with the latch member as the latch member reaches its latched position to retain the latch member and hence to secure the implement relative to the housing.

Thus a positive force is required to move the latch member to its latched position, in which position, the locking element will retain the latch member.

It has been found that where the working arm is mounted on a vehicle, the vehicle having a control cab where the operator sits, this operation can be carried out by an operator without the operator having to dismount from the cab.

The latch member may be engageable with the receiving means of the working implement when in its free position so that the latch member may be moved to its latched position by moving the working implement relative to the housing.

The receiving means of the working implement may comprise an elongate part such as a bar or tube, the latch member having a recess to receive the elongate part.

Preferably, the latch member is pivotable between its free and latched positions about a first axis, and the elongate part of the working implement where provided may extend generally parallel to the first axis at least when retained. The locking element where provided is also preferably pivotal about an axis generally parallel to the first axis against the force of the resilient biasing means.

The housing may be provided with a further formation which receives a retaining part of the working implement, the further formation of the housing and the retaining part of the working implement being engageable when the latch member is in its free position and being maintained in engagement as the latch member is moved to its latched position so that the working implement is secured relative to the housing by both the latch member engaging the co-operating receiving means of the working implement, and the further formation of the housing engaging the retaining part of the working implement.

The retaining part of the working implement may comprise a further elongate part such as a bar or tube, and the further formation of the housing may comprise a further recess.

The recess of the further formation may face in a direction generally away from the recess of the latch member at least when the latch member is in its latched position.

The housing may be secured to the working arm for movement about a further axis also generally parallel to the first axis so that the working implement when secured to the housing, can be moved relative to the working arm, for example by fluid power means, as a unit with the housing. The working arm may also be pivotable relative to a body of the excavating vehicle about an axis or axes generally parallel to the first axis.

The working arm may be mounted on a vehicle, or on a fixed base as required.

According to a second aspect of the invention we provide an excavating or loading vehicle having a working arm pivotally mounted thereon for movement about a first axis, a device according to the first aspect of the invention secured to the working arm for movement about a second axis generally parallel to the first axis.

The device secured on the outer end of the working arm may be releasably engaged with a working implement.

BRIEF DESCRIPTION OF THE DRAWINGS

The invention will now be described with the aid of the accompanying drawings in which.

DETAILED DESCRIPTION OF THE PREFERRED EMBODIMENTS

Figure 1:
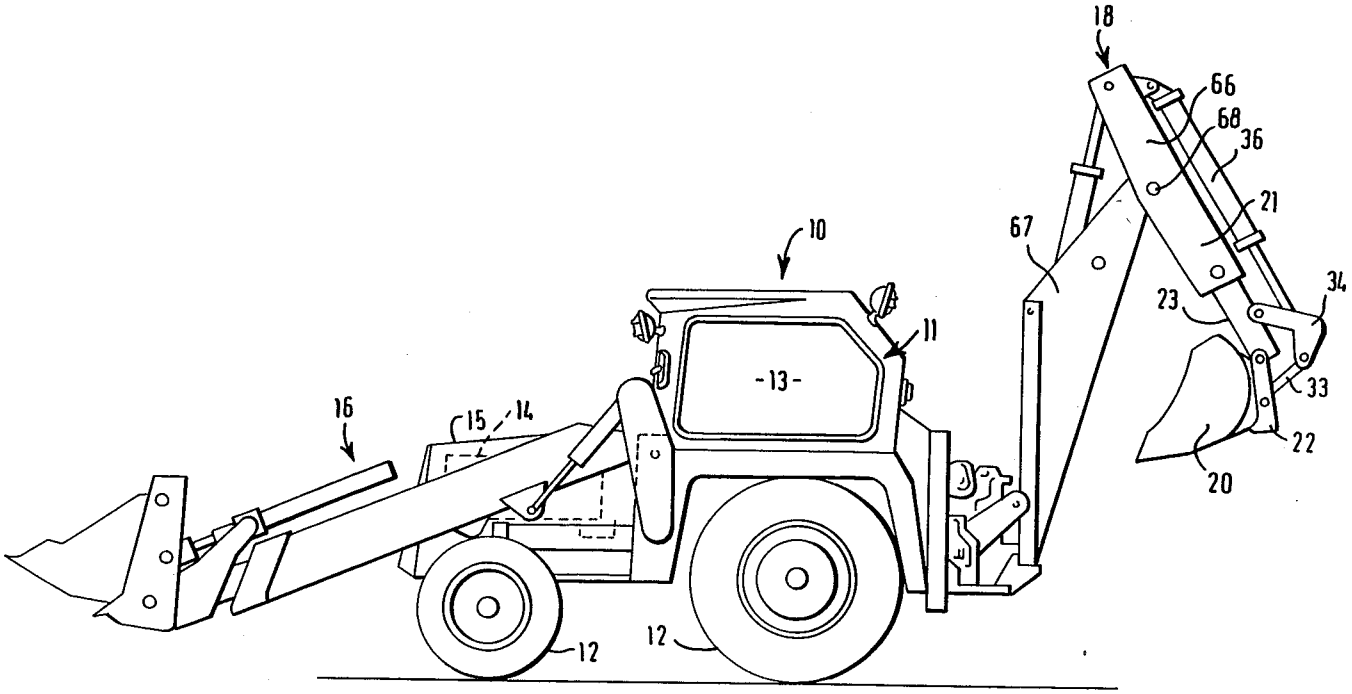
FIG. 1 is a side diagrammatic view of an excavating vehicle with which device in accordance with the first aspect of the invention may be used.
Figure 2:
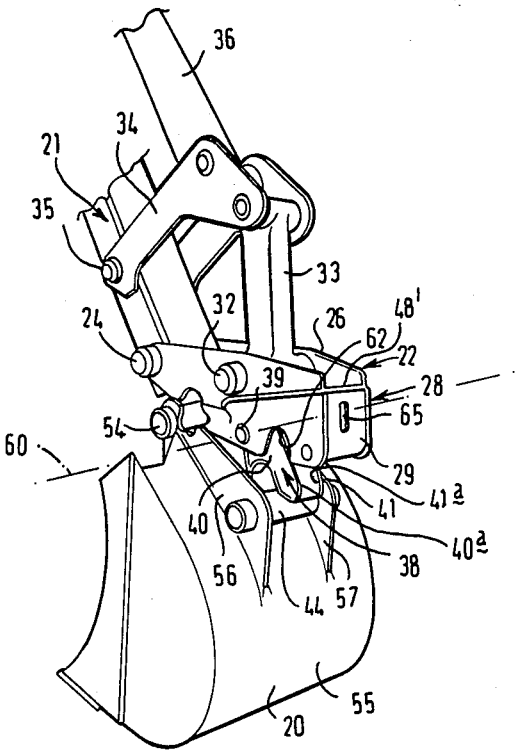
FIG. 2 is an enlarged perspective view of the outer end of the working arm of the vehicle of FIG. 1.

Referring first to FIG. 1, there is shown an excavating vehicle 10 comprising a body 11 having ground-engaging wheels 12, a cab 13, and an engine 14 mounted beneath a bonnet 15.

A conventional two boom loading arm assembly 16 is provided at the front of the vehicle, and at the rear of the vehicle, an excavating arm assembly 18 is provided.

Such vehicles are generally well known and hence detailed description of the vehicle overall is not considered necessary.

Vehicle 10 shown in FIG. 1 differs from conventional vehicles in that an excavating bucket shown at 20, is releasably mounted on an excavating arm 21 of the assembly 18, by a device 22 which permits an operator to at least mount the bucket at the end of the arm 21 without having to dismount from his cab 13.

Referring now also to FIGS. 2 to 5, the device 22 is pivotally secured to the outer end 23 of the excavating arm 21, by means of a pivot pin 24 which passes through side walls 25,26, of the device 22, and through suitable bearings in the end 23 of the arm 21.

The side walls 25,26, each comprise part of a housing 28, the side walls 25,26, being secured together side by side with the end 23 of the excavating arm 21 therebetween, by an end wall 29 and a plate 30 which provides a retaining formation 31 for a purpose explained below.

A second pivot pin 32 pivotally mounts a strut 33 to the housing 28, which strut 33 is pivotally connected to a dog-leg shaped strut 34 which is in turn pivotally connected to the arm 21 as shown at 35.

A hydraulic ram 36, extends between the strut 34 to the excavating arm 21 to facilitate tipping of the bucket 20 relative to the arm 21, again as described below.

Pivotally mounted on the housing 28 is a latch member 38, the pivot being shown at 39.

The latch member 38 comprises a pair of side plates 40, 41, interconnected by the pivot 39 at one end and by an end plate 42 at the other end, which end plate 42 presents a recess 43 which, in use, engages a receiving means 44 of the bucket 20.

The end plate 42 provides an abutment 45 and the side plates 40 and 41 are each pivotally connected to the one ends of a pair of coil springs 46 (only one of which can be seen), the other ends of the springs 46 being secured, pivotally, to a locking element assembly 47.

Figure 3:
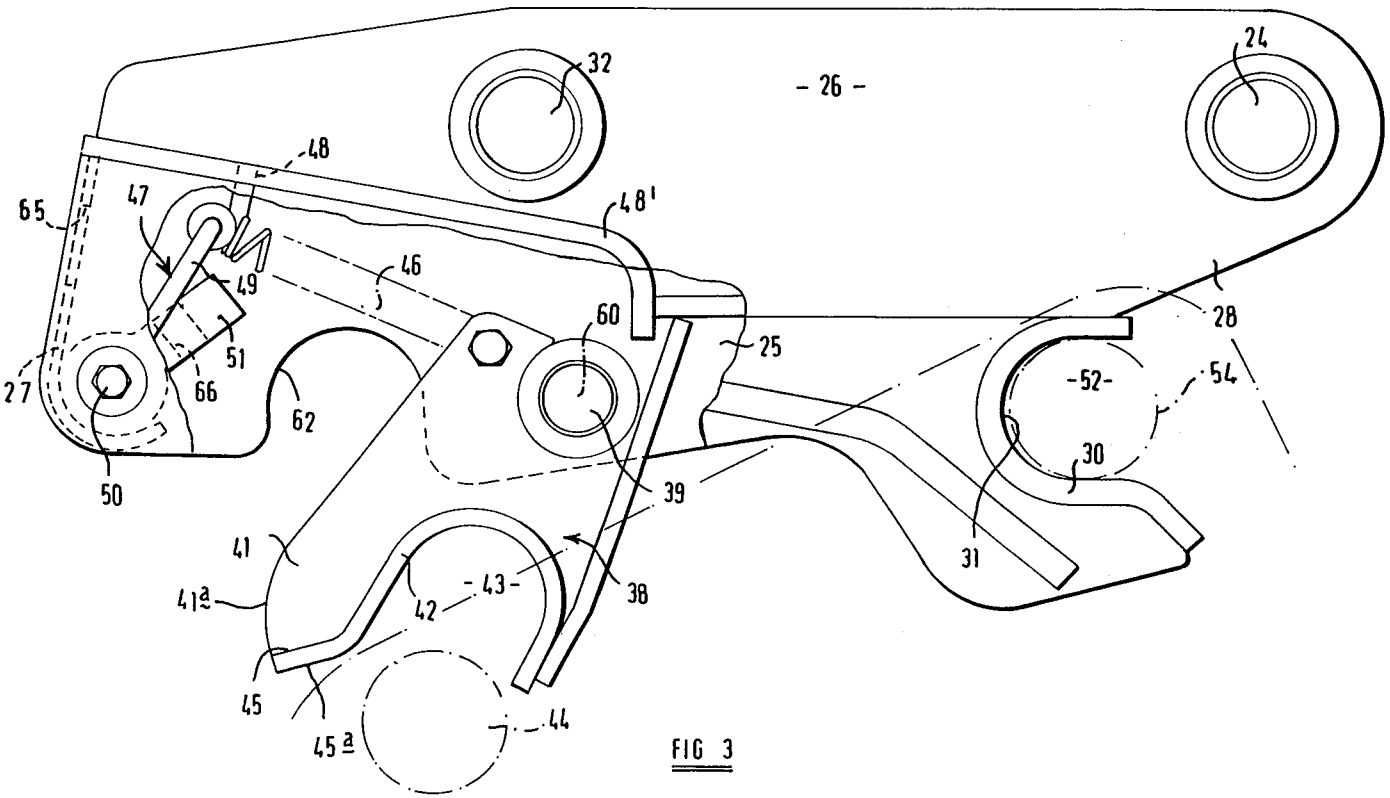
FIG. 3 is a side elevation of the device for mounting the excavator bucket shown in FIGS. 1 and 2, with part of the housing of the device broken away to reveal internal features thereof, with the device being shown with the latch member thereof in a free position.
Figure 4:
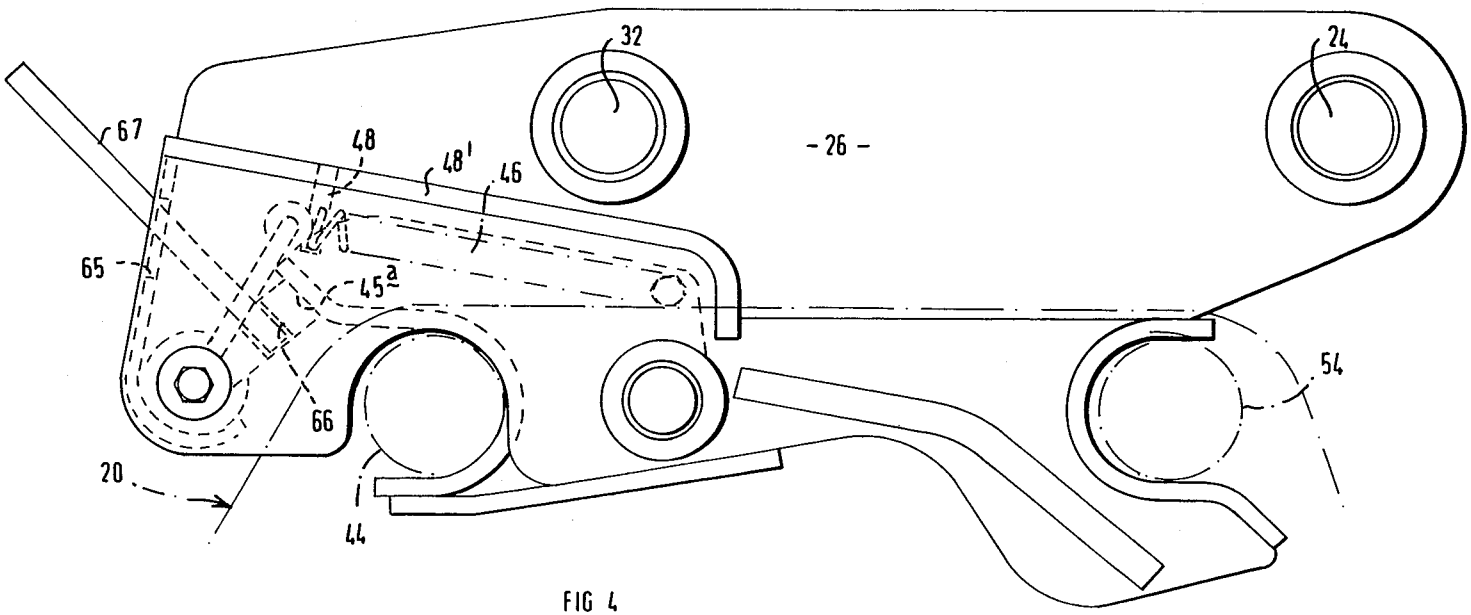
FIG. 4 is a view similar to FIG. 3 but with the latch member shown in a latching position.

The latching member 38 is movable between a free position shown in FIG. 3 to a latched position shown in FIG. 4 with the receiving means 44, against the force of the springs 46, to retain the receiving means 44 of the bucket 20.

The locking element assembly 47 is prevented from moving towards the latching member 38 as the springs 46 become stretched, by means of a tension pin 48 which depends from a roof plate 48' of the housing 28.

The locking element assembly 47 comprises a first part 49 of inverted U-shape, to the bottom of the U the springs 46 are secured, the free ends of the U-shaped first part 49 extending to a pivotal connection 50 on the housing 28.

The free ends of the first part 49 are rigidly secured to a second part 51 which has a circular section base which pivots relative to the end wall 29, retaining pivots 50 passing through the side walls 25, 26 to prevent the locking element assembly 47 from moving as the springs 46 become tensioned. Thus, the first part 49 and the second part 51 may move around the pivots 50. However because of the tension pin 48, only anticlockwise movement from the position shown in FIG. 3 of the locking element assembly 47 is permitted.

The second part 51 provides a catch which extends towards the latching member 38.

As the latching member 38 moves from its free position towards its latched position, the abutment 45 provided by the end plate 42, will engage the second part 51 of the locking element assembly 47. If sufficient force is applied, the second catch part 51 of the locking element assembly 47 will be moved away from the latching member 38 anti-clockwise as seen in FIGS. 3 and 4 of the drawings, about pivots 50, against the force of now stretched springs 46 to further stretch the springs 46 sufficiently to allow the abutment 45 to pass. Once the abutment 45 has passed the second catch part 51 of the locking element assembly 47 will spring back under the force of springs 46 so that the second catch part 51 of the locking element assembly 47 engages beneath a lower abutment face **45*a* of the latching member 38, as shown in FIG. 4**.

Preferably the leading edges **40*a*,41*a* of the plates 40,41 are shaped to engage the part 51** to assist in deflecting the locking element assembly.

Thus the latching member 38 will be retained in a latched position by the latch 51 of the locking element assembly 47.

As mentioned above, the housing 28 further comprises a retaining formation 31. This provides a recess 52 to receive a further part 54 of the bucket 20. The recess 52 opens away from the latching member 38 and when the latching member 38 is in its latched position (see FIG. 4) the recess 43 provided by the latching member and recess 52 provided by the retaining formation, extend in generally mutually opposite directions.

The bucket 20 is of conventional construction generally but has on a curved surface 55 thereof, a pair of brackets 56,57, between which extend the receiving means 44 and 54.

In the present case, the receiving means 44 and 54 each comprise a solid bar which extends from plate 56 to plate 57 in a direction generally parallel to the axis of pivot of the latching member 38 which is shown at 60, but the receiving means could comprise tubes, or simple catch elements engagable by a suitable latch member 38 and retaining formation on the housing 28 of device 22.

To mount the bucket 20 on the end 23 of the excavating arm 21, the following procedure is adopted.

With the latching member 38 in the position shown in FIG. 3, the operator manoeuvres the excavating arm 21 until the bar 54 of the bucket 20 is received within the recess 52 of the retaining formation 31 of the housing 28 of the device 22. Thus the bucket 20 and device 22 will be in the relative positions of FIGS. 2 and 3.

The bucket 20 is then lifted relative to the device 22. This may be achieved by causing the bucket 20 to swing about the axis of bar 54 by moving the excavating arm rapidly away from the body 11 of the vehicle and suddenly stopping movement of the arm 21 so that the bucket 20 will swing. As the bar 44 of the bucket 20 moves upwardly, this will be received within recess 42 of the latching member 38 and will carry the latching member 38 against the force of springs 46 upwardly to the position shown in FIG. 4, when the locking element assembly 47 will latch the latching member 38 as described hereinbefore.

Thus the bar 44 will be received in the recess 43 and the bar 54 of the bucket 20 will be received in the recess 52.

It can be seen that the housing 28 has formations 62 in the side walls 25 and 26 which register with the recess 43 of the latching member 38 when the latching member 38 is in its latched position, to further retain the bar 44 relative to the housing 28. Because the recesses 43, 52, open in opposite directions, and formations 62 of the housing 28 register with recess 43, when the latching member 38 is in its latched position, the bucket will be securely mounted on the end 23 of the excavating arm 21.

A bucket 20 may be especially constructed to be used with the device 22 as described, although an existing bucket can be modified fairly simply by adapting the existing brackets and other equipment by which the bucket is ordinarily engaged with the excavating arm 21.

One bucket may quickly be replaced by another bucket for different excavating applications. For example, different sizes of bucket 20 may be quickly hitched and mounted on the outer end 23 of an excavator arm 23, without an operator having to dismount from his operating cab.

To remove a bucket 20, the following procedure is adopted.

In the end plate 29 of the housing 28, an opening 65 is provided. The first part 49 of the locking element assembly 47 also provides an opening 66 comprising a shallow locating recess.

A lever 67, shown in FIG. 4, is inserted through opening 65 into engagement with the opening 66 in the second part 51 of the locking element assembly 47 and levered downwardly to move the locking element assembly 47 sufficiently against the force of the tension springs 46 so that the second catch part 51 of the locking element 49 will release the abutment 45 of the latch member 38. The weight of the bucket 20 will be sufficient to pivot the latch member 38 towards its free position, although of course the springs 46 will give assistance.

In another embodiment (not shown) a single acting hydraulic ram may be provided adjacent the catch 51. operable on the actuation of a control by by the operator from within the cab, to move the catch 51 to release the latch member 38. The ram may be returned to move the latch 51 to its starting position by the springs 46 or by separate resilient means.

In each case, although as described, to effect movement of the latching member 38 towards its latched position, the bucket has been described as being caused to swing about the axis of the bar 54, it will be appreciated that alternatively, with the bucket 20 resting on the ground, the device 22 may be lowered relative to the bucket by extending hydraulic ram 36.

As described, the invention has been applied to an excavating arm assembly 18 of a vehicle 10.

The excavating arm 21 comprises a dipper arm part 66 and first arm part 67, pivotally interconneted as shown at 68 in FIG. 1. The first arm part 67 is pivotally mounted with respect to the vehicle 10 and can also move laterally relative thereto.

Alternatively, the invention could be applied to the loader arm assembly 16 at the front of the vehicle 10.

Further, although the invention has been applied to an arrangement in which a working implement comprises a bucket 20, of course the invention could be applied to the mounting of any other working implement on the end of a working arm. For example, the invention could be applied to the mounting of a loading fork assembly.

The invention has been described as being applied to an excavating vehicle 10, although it will be appreciated that the invention is applicable wherever a working implement is to be mounted on the end of a working arm whether the working arm is mounted on a vehicle or a fixed support.

I claim:

1. A device for releasably mounting a working implement on a working arm of an excavating vehicle, the device comprising a housing, means securing the housing to the working arm, a latch member mounted on the housing for movement relative to the implement between a free position and a latched position, a common resilient biasing means for biasing the latch member towards its free position, the working implement having a cooperating receiving means, the latch member being engageable with the cooperating receiving means when the latch member is in a free position and the latch member retaining the receiving means of the implement when moved against the force of the resilient biasing means, to its latched position, the housing further comprising a locking element and said common resilient biasing means further biasing the locking element to a retaining position, the locking element being movable against the force of the resilient biasing means as the latch member is moved to said latched position, and the locking element springing back into engagement with the latch member as the latch member reaches its latched position to retain the latch member and hence to secure the implement relative to the housing.

2. A device according to claim 1 wherein the co-operating receiving means of the working implement comprises an elongate part, the latch member having a recess to receive the elongate part, when the latch member is in the free position, and to retain the elongate part when the latch member is in its latched position.

3. A device according to claim 2 wherein the latch member is pivotable between its free and latched positions about a first axis, and the elongate part of the working implement extends generally parallel to the first axis at least when retained.

4. A device according to claim 2 wherein the locking element is pivotal about an axis generally parallel to the first axis against the force of the resilient biasing means.

5. A device according to claim 1 wherein the housing is provided with a further formation which receives a retaining part of the working implement, the further formation of the housing and the retaining part of the working implement being engageable when the latch member is in its free position and being maintained in engagement as the latch member is moved to its latched position so that the working implement is secured relative to the housing by both the latch member engaging the co-operating receiving means of the working implement, and the further formation of the housing engaging the retaining part of the working implement.

6. A device according to claim 5 wherein the retaining part of the working implement comprises a elongate part and the further formation of the housing comprises a recess, the recess of the further formation facing in a direction generally away from the recess of the latch member at least when the latch member is in its latched position.

7. A device according to claim 3 wherein the housing is secured to the working arm for movement about a further axis generally parallel to the first axis so that the working implement when secured to the housing, is movable relative to the working arm, as a unit with the housing.

8. A device according to claim 7 wherein the working arm is pivotably mounted on a body of an excavating vehicle for movement about an axis generally parallel to the first axis.

9. A device according to claim 1 wherein the working arm is pivotally mounted for movement about a first axis and said device is secured to the working arm for movement about a second axis generally parallel to the first axis.

* * * * *